United States Patent [19]

Lloyd

[11] 4,061,960

[45] Dec. 6, 1977

[54] APPARATUS FOR PROVIDING REGULATED DIRECT CURRENT TO MAGNETIZING COILS FOR NON-DESTRUCTIVE MAGNETIC TESTING

[75] Inventor: Donald Lloyd, Houston, Tex.

[73] Assignee: Tex-Tube Division of Detroit Steel Corporation

[21] Appl. No.: 638,547

[22] Filed: Dec. 8, 1975

[51] Int. Cl.[2] ..... G05F 1/64

[52] U.S. Cl. ..... 323/9; 323/43.5 R; 323/57; 324/225; 361/146; 324/238

[58] Field of Search ..... 323/6, 9, 43.5 R, 43.5 S, 323/45, 57; 324/37, 38, 40; 321/2, 16; 361/143, 146

[56] References Cited

U.S. PATENT DOCUMENTS

| | | | |
|---|---|---|---|
| 3,011,095 | 11/1961 | Kriechbaum | 323/57 |
| 3,039,252 | 1/1962 | Guldemond et al. | 323/43.5 R |
| 3,235,788 | 2/1966 | Riebs | 323/43.5 S |
| 3,345,557 | 10/1967 | Perrins | 323/43.5 S |
| 3,588,684 | 6/1971 | Ridgeway | 324/38 |
| 3,753,085 | 8/1973 | Morton et al. | 324/37 |
| 3,913,007 | 10/1975 | Gilmore | 323/43.5 S |

*Primary Examiner*—Gerald Goldberg
*Attorney, Agent, or Firm*—Pravel, Wilson & Gambrell

[57] ABSTRACT

An apparatus for providing regulated direct current to magnetizing coils of a non-destructive magnetic testing apparatus for detecting welding defects in pipe, which includes a variable output auto-transformer, a rectifying and filtering circuit, a meter relay for detecting direct current output magnitudes from the rectifying circuit at upper and lower bounds of a predetermined range required for proper operation of the testing apparatus, and a synchronous motor for adjusting the output of the variable transformer, in response to a control signal from the meter relay, until the direct current magnitude is within the predetermined range.

8 Claims, 2 Drawing Figures

APPARATUS FOR PROVIDING REGULATED DIRECT CURRENT TO MAGNETIZING COILS FOR NON-DESTRUCTIVE MAGNETIC TESTING

BACKGROUND OF THE INVENTION

1. Field of the Invention

The present invention relates to current regulating apparatus for providing regulated direct current to the magnetizing coils of a non-destructive testing apparatus used to detect welding defects in pipe.

2. Description of the Prior Art

A non-destructive testing apparatus for detecting welding defects in pipe as the pipe is moved at variable speeds down a mill run is shown in U.S. Pat. No. 3,753,085, having a substantially increased signal-to-noise ratio over prior non-destructive testing apparatus and permitting more positive detection of defects in both longitudinal and circular welds.

In these apparatus, variations in the speed of the pipe as it moved down the mill run induced voltage variations in the detector signal output. In order to provide a signal output with a substantially high voltage to accurately indicate a weld defect, the current level supplied to the magnetizing coils had to be sufficiently high to induce signal output voltages larger than the voltages caused by the variations in pipe speed. However, if the current level became too high, the signal-to-noise ratio of the detector output deteriorated below the high level required for accurate testing. Thus, for highly accurate testing results, current levels supplied to the magnetizing coils were required to be maintained within a relatively narrow range. In such testing apparatus, the problem was further compounded in that the energizing current for the magnetizing coils varied as the temperature of the coils increased during testing operations.

In the past, in order to prevent current variations and maintain current levels within the narrow range for accurate results, the current to the magnetizing coils had to be frequently adjusted manually in order to maintain the current levels required for proper operation of the testing apparatus.

So far as is known, prior art direct current sources for pipe testing apparatus were not capable of supplying a closely regulated current within the limited range required to provide a signal output with high signal-to-noise ratio and yet of a sufficiently large magnitude to compensate for pipe speed variations, particularly in a variable temperature environment.

SUMMARY OF THE INVENTION

Briefly, the present invention provides a new and improved current regulating apparatus for providing regulated direct current. The current regulating apparatus includes a variable transformer for varying the magnitude of alternating current received from an alternating power source, a rectifying circuit for converting the alternating current from the transformer means into direct current, and a detector for detecting the magnitude of the direct current. The detector senses if the current is within a predetermined range of current magnitudes and provides a control signal when the sensed direct current magnitude is at or near a defined limit or threshold of the predetermined range of current magnitudes. The control signal is provided to an adjusting motor for adjusting the output of the variable transformer until the direct current from the rectifying circuit is within the predetermined range.

The current regulating apparatus is particularly adapted to provide direct current to the magnetizing coil of a non-destructive testing apparatus having detectors for detecting welding defects in pipe. The range of predetermined current magnitudes provided to the magnetizing coils is within limits required to maintain the high signal-to-noise ratio of the detector output of the testing apparatus and yet permit detection of welding defects in the pipe while the pipe is moving at variable speeds down the mill run.

DESCRIPTION OF THE PREFERRED EMBODIMENT

Figures 1, 2:
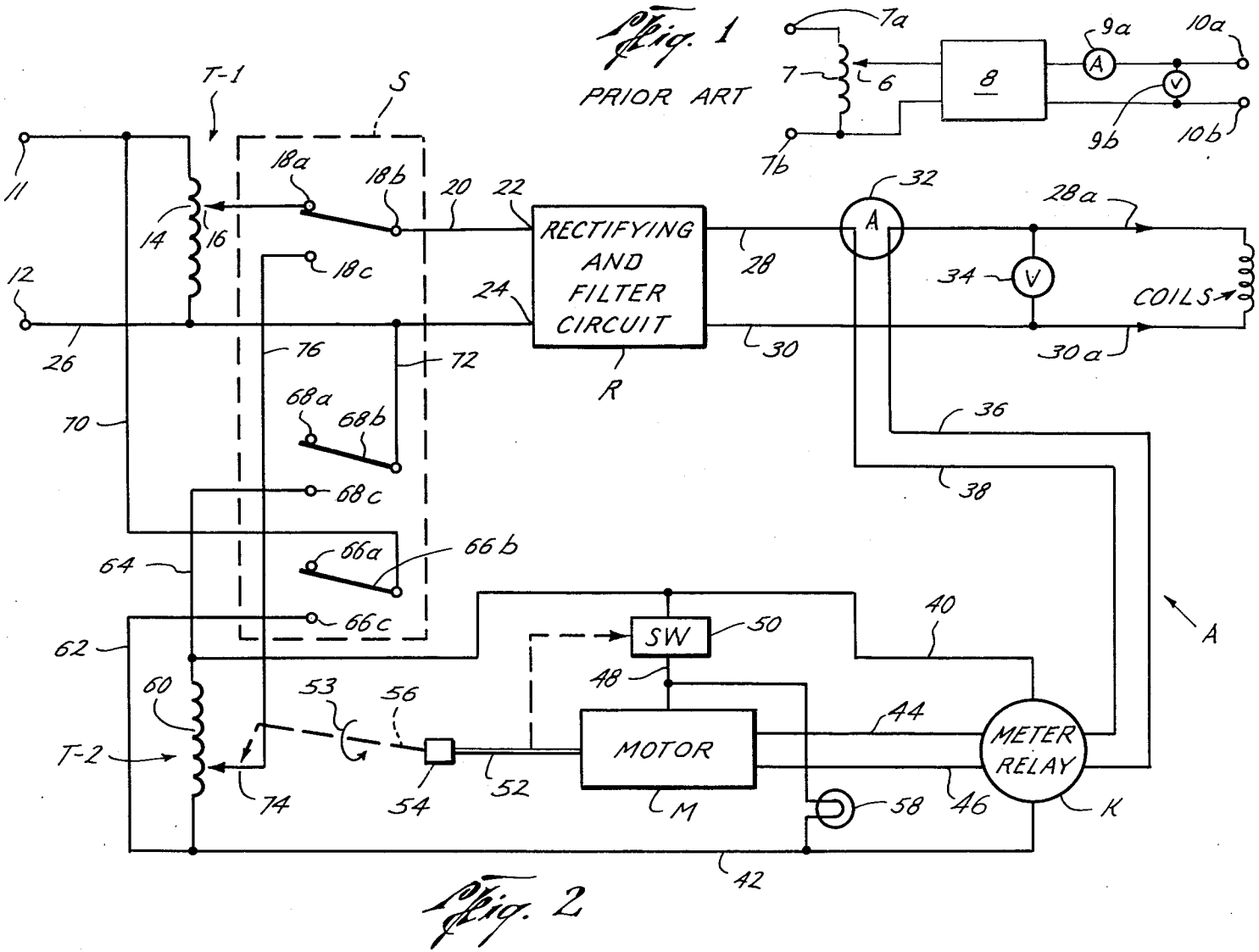
Fig. 1 PRIOR ART
FIG. 1 is a schematic electrical circuit diagram of prior art apparatus.
FIG. 2 is a schematic electrical circuit diagram of the current regulating apparatus of the present invention.

In a typical prior art apparatus (FIG. 1), a tap 6 was manually adjusted to control output of an auto-transformer 7 furnishing electrical current from alternating current power supply input terminals **7*a* and 7*b* to a rectifier circuit 8 which provided direct current to energizer coils of the non-destructive testing apparatus through an ammeter 9*a* and a voltmeter 9*b* at output terminals 10*a* and 10*b***. As set forth above, certain problems arose in attempting to accurately control current levels provided by this type of prior art apparatus.

The letter A (FIG. 2) designates generally the current regulating apparatus of the present invention which provides regulated direct current to the magnetizing coils of the non-destructive testing apparatus for detecting welding effects in pipe as the pipe is moved down a mill run, for example of the type shown in U.S. Pat. No. 3,753,085, assigned to the assignee of the present invention.

The current regulating apparatus A receives alternating current input power from a suitable alternating current power source at input terminals 11 and 12. A first variable current output auto-transformer T-1 electrically connected to the terminals 11 and 12 receives alternating current power through a coil or winding 14 and provides alternating current through a manually adjustable tap 16 when a suitable three pole-double throw switch S is in its normally closed position as shown in the drawings. The level of output current from the coil 14 is variable and may be manually adjusted by moving the position of the tap 16.

When the switch S is in the closed position, current flows from a contact **18*a* through a pole 18*b* of the switch S over a conductor 20 to an input terminal 22 of a rectifying and filter circuit R. A second input terminal 24 of the rectifying and filter circuit R is electrically connected to the input terminal 12 by a conductor 26**.

The rectifying and filter circuit R is a conventional rectifying circuit, converting input alternating current into output direct current at an output level dependent on the level of the input alternating current. The rectifying circuit R provides the output direct current over a conductor 28 and a conductor 30, which includes a current sensing ammeter 32 connected therein, at terminals **28*a* and 30*a* to the magnetizing or energizing yoke coils of the pipe testing apparatus. A voltmeter 34 is connected between the conductors 28 and 30** to sense the voltage output of the rectifying circuit R.

With the present invention, it has been found that with the apparatus A having a second adjustable auto-transformer T-2 selectively connected therein in a manner to be set forth, closely regulated current levels within a limited range are provided to obtain high signal-to-noise ratios in the magnetic testing apparatus signal output, but with a sufficiently large magnitude of signal voltage to compensate for pipe speed variations in the moving pipe, particularly in variable temperatures. The current level output of the auto-transformer T-2 is automatically adjusted by an adjusting motor M in response to control signals from a current sensing control meter relay K, so that the output direct current from the rectifying circuit R is accurately maintained within the limited range.

The meter relay K is electrically connected in parallel with the ammeter 32 by conductors 36 and 38 and receives a current through conductors 36 and 38 proportional to the current output of the rectifying circuit R flowing through the conductor 28 to the magnetizing coils of the testing apparatus. The meter relay K is also electrically connected across the auto-transformer T-2 by electrical conductors 40 and 42 to receive operating power from the input power source in a manner to be set forth. The meter relay K is electrically connected by conductors 44 and 46 to the adjusting motor M to provide a power control signal thereto.

The meter relay K senses the magnitude or level of the current flowing through the conductor 28 and does not provide the power control signal over conductors 44 or 46 when the current level sensed is within higher and lower thresholds or bounds of a predetermined range of current magnitudes. This predetermined range of current magnitudes, and the higher and lower thresholds thereof, are determined by the required signal-to-noise ratio of the testing apparatus, variations in speed of the pipe being tested, temperature ranges in the testing environment and the like.

The relay K provides the power control signal over the conductor 44 to the adjusting motor M when the current magnitude sensed by the meter relay K is at the higher threshold of the range of current magnitudes. Conversely, the relay K provides the power control signal over the conductor 46 to the motor M when the current magnitude is at the lower threshold of the range of current magnitudes.

A suitable meter relay K is a contactless meter relay having a current rating corresponding to the range of current levels required for the testing apparatus, for example 10 amperes. The meter relay K also includes adjustably set pointers on the meter face for setting and indicating thereon the higher and lower thresholds of the range of current magnitudes, preferably sufficiently accurate to be within 0.5% of full amperage, for example 0.05 amperes.

In the preferred embodiment, the meter relay K includes a photodetector circuit for optically sensing the position of the amperage indicating needle or pointer on the meter face, and forming a signal when the current level is at the higher or lower thresholds of the current magnitude range. The photodetector circuit of the meter relay K detects the position of the amperage indicating pointer at the threshold level set on the meter face and responds to the current level reaching such threshold by energizing a suitable relay or switch in the meter relay K to provide alternating current over either the conductor 44 or the conductor 46, depending on the threshold, to the adjusting motor M. A suitable meter relay K is the Model 29XA contactless meter relay manufactured by the Simpson Electric Company of Chicago, Illinois.

The power control signal from the meter relay K, whether over the conductor 44 or the conductor 46, serves as operating power for the motor M. A current return path for the control signal provided to the motor M over either such conductor is formed over a return conductor 48 through a safety or limit switch 50 to the power return conductor 40.

The adjusting motor M responds to the control signal provided from the meter relay K and rotates a shaft 52 in a direction determined by the particular conductor providing the control signal thereto. When the control signal from the meter relay K is provided over the conductor 44, indicating a current level at the higher threshold, the motor M rotates the shaft 52 in a direction indicated by the arrow 53 in the drawings, decreasing the current output from the auto-transformer T-2. Conversely, when the control signals provided over the conductor 46, indicating a lower threshold level, the motor M rotates the shaft 52 in a direction opposite that of the arrow 53.

A universal or joy coupling 54 connects the motor shaft 52 to a shaft 56 of the auto-transformer T-2, shown schematically by a dashed line.

The adjusting motor M is a stepping motor, preferably a single phase, stepping, synchronous motor capable of accurately adjusting the position of the transformer shaft 56 over a precise arcuate increment of a small number of degrees of motor shaft rotation, 5° increments of rotation for example, in order to control the output of the auto-transformer T-2 to maintain the output of the apparatus A within the narrow range of magnitudes required for the proper operation of the testing apparatus. The adjusting motor M must also be capable of providing sufficient torque to adjust the transformer shaft 56 at a sufficiently slow rotational speed to accurately and precisely control movement of the shaft 56 with producing oscillatory movement of the shaft 56 during starting and stopping. In addition, the motor must be capable during starting and stopping of going from start to full speed and from full speed to stop rapidly to prevent overshoot, and thereby oscillations. Suitable adjusting motors of this type are the synchronous stepping motors sold by The Superior Electric Company of Bristol, Connecticut.

The safety or limit switch 50 connecting the adjusting motor AC return conductor 48 to the AC return conductor 40 is normally in the closed position to ensure that the motor M does not rotate the transformer shaft 56 beyond the required increment of movement. The safety switch 50 is preferably a microswitch mounted on the motor shaft 52 and is calibrated to open when the shaft 52 is rotated beyond the required movement increment. When open, the switch 50 stops flow of operating power to the motor M by opening the electrical connection to the return conductor 40. It should be noted that in addition to microswitches other types of switches are suitable for use as the safety switch 50.

A conventional indicator light 58 is electrically connected between the power conductor 42 and the motor return conductor 48 to indicate when the motor M is receiving power.

The auto-transformer T-2 has a winding or coil 60 which is electrically connected between conductors 62 and 64 which are, in turn, electrically connected to contacts 66c and 68c of the three-pole double throw switch S. The auto-transformer T-2 is also electrically connected to the conductors 40 and 42 to provide power to the meter relay K.

When the switch S is in the normally closed position, pole contacts **66*b* and 68*b* thereof are electrically connected to open contacts 66*a* and 68*a*, respectively, to prevent the transformer T-2 and meter relay K from receiving alternating current power. Contacts 66*c* and 68*c* of the switch S are, however, electrically connected to poles 66*b* and 68*b*, respectively, when the switch S is moved to the open position opposite from that shown in the drawings. When the switch S is in the open position, the pole 66*b* of the switch S is connected to power input terminal 10 by conductor 70, and the pole 68*b* is connected to input terminal 12 by conductors 72 and 26** to provide input power to the transformer T-2.

The secondary voltage tap 74 of the auto-transformer T-2 is electrically connected by conductor 76 to contact **18*c* of the switch S, so that the auto-transformer T-2 provides input power to the rectifying circuit R when the switch S is in the open position. The tap 74 of the auto-transformer T-2 is mechanically connected to the shaft 56** and is thus moved by the motor M to adjust the output to the rectifying circuit R from the auto-transformer T-2. Suitable auto-transformers T-1 and T-2 are those manufactured and sold by Superior Electric Company of Bristol, Connecticut.

OPERATION

The current regulating apparatus A operates in both a manual and an automatic mode, as controlled by the position of the switch S. In the manual mode, the switch S is in the closed position shown in the drawings (FIG. 2) so that the variable auto-transformer T-1 provides input power to the rectifying and filtering circuit R. The rectifying and filtering circuit R converts the alternating current in a conventional manner into a direct current output ranging from 0–10 amperes, depending on the magnitude of the alternating current output of the transformer T-1. The direct current is provided by the apparatus A to the magnetizing coils of the non-destructive testing apparatus. In order to adjust the direct current output of the apparatus A when the switch S is in the position shown in the drawings, an operator may manually adjust the output variable transformer T-1 by moving the tap 16 and observe the ammeter 32 to determine the amount of direct current flowing to the magnetizing coils.

However, as has been set forth, manual adjustment of current levels has been found to be undesirable when it is necessary to precisely control the current accurately within a precise range for non-destructive magnetic testing. When accurate and precise control of current levels within such a range is required, the switch S is moved to the open position opposite that shown in the drawings, converting operation of the apparatus A to the automatic mode.

Prior to switching to the automatic mode, with the switch S in the closed position, the current level from auto-transformer T-1 is manually adjusted until meter relay K indicates a current within the predetermined range is flowing to the magnetizing coils. The switch S is then moved to the open position so that the variable auto-transformer T-2 is electrically connected to the rectifying circuit R by the switch S. The rectifying circuit R converts the alternating current into direct current at a level determined by the output from the auto-transformer T-2 and provides the current to the magnetizing coils of the nondestructive testing apparatus.

The meter relay K senses and indicates the direct current magnitude, and provides a power control signal to the adjusting motor M when the current output from the circuit R reaches either threshold of the predetermined range of current magnitudes required for satisfactory testing. When such a threshold is reached, the motor M rotates the shaft 56 of the transformer T-2 which, in turn, adjusts the position of the tap 74 relative to the transformer winding 60, thereby adjusting the alternating current level provided from auto-transformer T-2 to the rectifying and filtering circuit R. The adjusting motor M thus automatically adjusts the alternating current from auto-transformer T-2 in response to the control signals from the meter relay K until the direct current output from rectifying circuit R is within the narrow range of direct current magnitudes, established by the ranges set on the meter relay K, which are required by the magnetizing coils of the testing apparatus for satisfactory testing. It is to be noted that this adjustment of the current output of the auto-transformer T-2 takes place automatically when the switch S is in the open position, so that the apparatus A automatically supplies a closely regulated current to the magnetizing coils within the limited range required for high signal-to-noise testing and compensation for pipe speed variation.

The foregoing disclosure and description of the invention are illustrative and explanatory thereof, and various changes in the size, shape, materials, wiring connections and contacts as well as in the details of the illustrated circuitry and construction may be made without departing from the spirit of the invention.

I claim:

1. A current regulating apparatus for providing regulated direct current within a predetermined range for non-destructive magnetic testing and detecting of welding defects in pipe, comprising:

a. variable transformer means for receiving current from an alternating current power source and providing varying output alternating current levels;

b. means for converting the alternating current output from said variable transformer means into direct current;

c. detecting means for detecting the magnitude of direct current from said means for converting, said detecting means including:

1. means for establishing a predetermined critical range of current magnitudes to a range of current magnitudes between lower and higher limits which are sufficiently low to maintain a high signal-to-noise ratio for detecting defects and sufficiently high to permit detection of welding defects in the pipe while the pipe is moving at variable speeds; and 2. control means for forming a control signal when the direct current magnitude is at either said lower or higher limit of the predetermined critical range of current magnitudes;

d. means responsive to the control signal formed by said control means for adjusting the direct current from said variable transformer means until the direct current magnitude is within the predetermined critical range to thereby regulate the direct current to the predetermined critical range; and e. magnetizing coil means electrically connected to said converting means for receiving the regulated direct current therefrom to thereby form a magnetic field for non-destructive magnetic testing and detecting of welding defects in pipe.

2. The apparatus of claim 1, wherein said control means comprises:

means for providing a control signal when the direct current magnitude is at the lower limit of the predetermined critical range, the lower limit being a predetermined current magnitude at which the detector signal has a sufficiently large magnitude to permit detection of welding defects in the pipe while the pipe is moving at variable speeds.

3. The apparatus of claim 1, wherein said control means comprises:

means for providing a control signal when the direct current magnitude is at the higher limit of the predetermined critical range, the higher limit being a direct current magnitude at which the signal-to-noise ratio of the detector signal is lower than a predetermined level necessary to permit detection of welding defects in pipe.

4. The current regulating apparatus of claim 1, wherein said detecting means comprises:

meter means for indicating the magnitude of the direct current.

5. The current regulating apparatus of claim 1, wherein the adjusting means comprises:

a motor having a rotating shaft for adjusting the output of said variable transformer means.

6. The apparatus of claim 5, wherein said adjusting means further comprises:

a limit switch for preventing rotation of said rotating shaft of said motor beyond a predetermined increment of movement.

7. The current regulating apparatus of claim 1, wherein:

a. said detecting means comprises meter means for indicating the magnitude of the direct current; and b. said adjusting means comprises a motor having a rotating shaft for adjusting the output of said variable transformer means.

8. The apparatus of claim 1, further including:

a. manually adjustable transformer means having a manually adjustable tap for receiving current from an alternating current source and providing manually controlled varying output alternating current levels; and b. switch means for selectively connecting said variable transformer means and said manually adjustable transformer means to said means for converting.

* * * * *